United States Patent [19]

Drzewiecki

[11] 4,373,553

[45] Feb. 15, 1983

[54] BROAD BAND FLUERIC AMPLIFIER

[75] Inventor: Tadeusz M. Drzewiecki, Silver Spring, Md.

[73] Assignee: The United States of America as represented by the Secretary of the Army, Washington, D.C.

[21] Appl. No.: 111,738

[22] Filed: Jan. 14, 1980

[51] Int. Cl.[3] ..... F15C 1/08

[52] U.S. Cl. ..... 137/840; 137/835; 137/836

[58] Field of Search ..... 137/834, 835, 836, 840

[56] References Cited

U.S. PATENT DOCUMENTS

| | | | |
|---|---|---|---|
| 3,283,767 | 11/1966 | Wright | 137/834 |
| 3,499,460 | 3/1970 | Ranier . | |
| 3,552,415 | 1/1971 | Small . | |
| 3,593,733 | 7/1971 | Roffman et al. . | |
| 3,608,573 | 9/1971 | Bahrton . | |
| 3,952,576 | 4/1976 | Drzewiecki et al. . | |
| 3,958,602 | 5/1976 | Manion et al. | 137/836 |
| 4,000,757 | 1/1977 | Freeman | 137/835 |
| 4,151,955 | 5/1979 | Stouffer | 137/835 |

FOREIGN PATENT DOCUMENTS 2238032 8/1971 Fed. Rep. of Germany .

*Primary Examiner*—A. Michael Chambers
*Attorney, Agent, or Firm*—Nathan Edelberg; Robert P. Gibson; Saul Elbaum

[57] ABSTRACT

A broad band flueric amplifier is disclosed which comprises means to increase the deflection of the fluid jet within the amplifier at higher frequencies of oscillation of the jet. The means for increasing jet deflection comprises vanes or protrusions positioned closely adjacent the jet path at selected distances from the nozzle. Acoustic feedback from these vanes or protrusions will assist the control pulse in deflecting the jet at selected frequencies of oscillation.

13 Claims, 5 Drawing Figures

BROAD BAND FLUERIC AMPLIFIER

RIGHTS OF THE GOVERNMENT

The invention described herein may be manufactured, used and licensed by or for the United States Government for governmental purposes without the payment to me of any royalty thereon.

BACKGROUND OF THE INVENTION

Typically, the bandwidth of AC fluidic or flueric amplifiers has been limited by the dynamic response of the input impedance. This impedance is such that the input control signal is generally attenuated significantly at higher frequencies. Often the bandwidth of available devices is insufficient for many purposes. Particularly, the increasing use of flueric amplifiers for FM and speech processing requires a wider band of operating frequencies.

Accordingly, it is an object of the invention to overcome the deficiencies of the prior art devices noted above.

Specifically, it is an object of the invention to provide a flueric or fluidic amplifier having a significantly increased bandwidth.

It is an object of the invention to provide a fluidic amplifier which will operate at a broad range of frequencies yet be simple in structure, having no moving parts.

SUMMARY OF THE INVENTION

Fluidic amplifiers such as the laminar proportional amplifier (LPA) are generally designed with a low aspect ratio (height/width ratio) to get wide bandwidth. This invention makes use of observed performance of high aspect ratio devices, having an aspect ratio greater than two. By placing multiple protrusions in an LPA amplifier, multiple peaks in gain can be achieved. Pressure feedback from the protrusions provides an amplification of jet deflection. This is the result of a phenomenon not unlike edgetones except that there is no instability present. This results in a device which has an order of magnitude wider bandwidth. Data shows that a device normally having a bandwidth of 300 Hz can exhibit a bandwidth of 3,000 Hz when this feedback is provided.

Several of the amplifiers of the invention can be operated in parallel, the peaks in gain of one amplifier being shifted in relation to the peaks in gain of another amplifier. The result will be an output which is smoother, having increased gain across a broad continuum of frequencies.

DESCRIPTION OF THE PREFERRED EMBODIMENT

Figure 1:
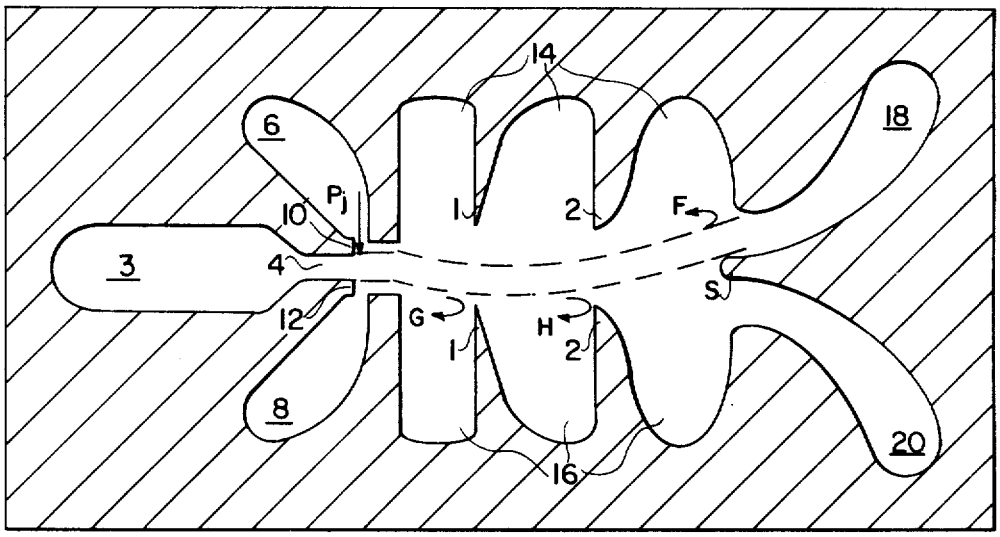
FIG. 1 illustrates an exemplary embodiment of the amplifier of the present invention.

Referring to FIG. 1, there is shown an amplifier comprising the essential features of the present invention. Supply 3 comprises a pressurized source of fluid which directs a jet out of nozzle 4. Control inputs 6 and 8 direct control pressure pulses through outlets 10 and 12, respectively. Vents 14 and 16 are maintained at constant pressure in the usual and well known manner for such devices. Either or both of outlets 18 and 20 will receive the fluid of the jet depending upon the position of the jet resulting from deflection by pressure pulses through outlets 10 or 12.

Vanes 1 and 2 are placed within the vent region between nozzle 4 and splitter S which separates outputs 18 and 20. The vanes extend to a position closely adjacent the path of the jet. The outer-most edge of each vane should extend to a position which is at a distance from the edge of the undeflected jet which does not exceed one-half the width of nozzle 4. The deflected jet should just touch the vane when the output of the amplifier is fully saturated.

In operation, fluid from supply 3 exits as a jet through nozzle 4 toward splitter S. Control pressures through inputs 6 and 8 generate control pulses at ports 10 and 12, respectively. These control pulses act to deflect the jet toward either output 18 or output 20. As the control pulses at ports 10 and 12 are reversed due to a frequency input, the jet will oscillate back and forth between the outputs 18 and 20 at the same frequency.

As the jet passes closely adjacent the edge of one of the vanes 1 or 2 acoustic energy will be generated and fed back toward the nozzle 4. This will also occur as the jet passes closely adjacent the splitter S. This acoustic energy will provide a pressure on the side of the jet adjacent the protrusion or vane. This pressure, along with the pressure pulses from ports 10 and 12, will act on the jet to determine the deflection thereof. If the acoustic feedback pulse and the control pulse from the port 10 or 12 are exactly in phase with one another, the two will combine to significantly increase the deflection of the jet. However, since there is a finite transport time for the fluid of the jet from nozzle 4 to any point downstream of the nozzle the acoustic pulse cannot be precisely in phase with the pulse from the control port. Therefore, the two pulses will combine to increase the deflection of the jet when they are 360° out of phase with one another, or exactly one wavelength apart.

At low frequencies of oscillation of the control pulse the position of the jet with respect to the outputs will always be substantially in phase with the control pulse. For example, when a positive pulse is applied at port 10, the jet will follow a path through output 20. As the frequency of oscillation of the control pulse is increased, the downstream position of the jet moves out of phase with the control pulse. As seen in FIG. 1, the control pulse $P_j$ is applied through port 10 while the downstream position of the jet, shown by dashed lines, is at output 18. The position of the jet at splitter S is therefore 180° out of phase wtih the pressure pulse $P_j$. Also, there is a normal phase lag between the jet position downstream and the control signal of 180° due to the finite jet transport time between the upstream and downstream positions. (This lag can be observed in a stream of water exiting from the nozzle of a garden hose as the hose is rapidly moved back and forth.) The result is that the acoustic feedback, shown by arrow F in FIG. 1, generated at the splitter is 360° out of phase with the control impulse at port 10. Since the acoustic energy travels at the speed of sound, much more rapidly than does the jet, the acoustic pressure may be considered to instantly combine with the pulse from port 10 to increase the deflection of the jet.

Figure 2:
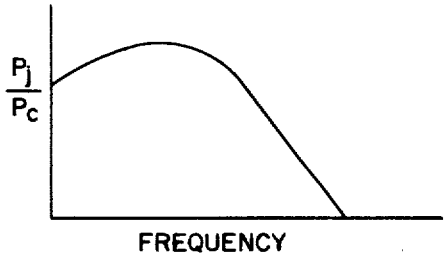
FIG. 2 graphically illustrates the relationship between frequency of oscillation and the effective control energy applied to an oscillating jet in a laminar proportional amplifier.

The manner in which this phenomenon increases the operation bandwidth of the amplifier will be described with reference to FIGS. 2 and 3. In FIG. 2, $P_c$ represents the control pressure which exists at input 6 or 8 of the amplifier, while $P_j$ represents the actual pressure pulse generated at the output ports 10 and 12. Since the input signal $P_c$ is fed through an impedance, the signal $P_j$ becomes significantly attenuated at higher frequencies. This is illustrated in FIG. 2 by the rapidly decreasing ratio of $P_j$ to $P_c$ at increasing frequencies. Due to this loss of control pressure at higher frequencies, the gain of prior art amplifiers significantly diminished or disappeared at such frequencies. The present invention alleviates this problem by providing the above discussed acoustic pressure signals in the higher frequency range, thus increasing the gain of the amplifier in this range.

Figure 3:
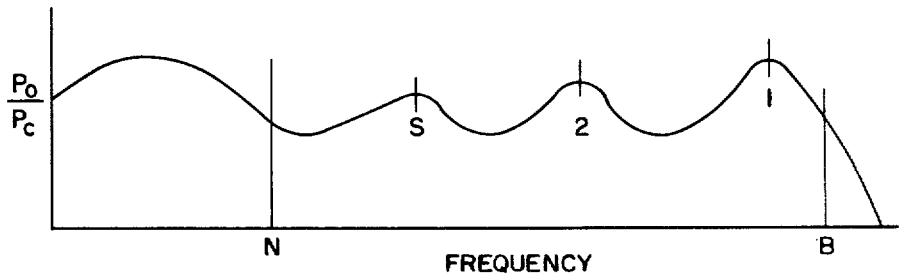
FIG. 3 shows the relationship between frequency of oscillation and gain in the amplifier of the present invention.

FIG. 3 graphically illustrates the relationship between frequency and the ratio of the output pressure to the control pressure (gain) in the amplifier of the present invention. At lower frequencies the device operates substantially in the same manner as the prior art devices. This can be seen in that portion of the gain curve which terminates at point N along the axis which represents frequency. Point N signifies the normal bandwidth of a prior art amplifier since it is at this point where the gain diminishes substantially due to the loss of pressure at the control port, as discussed with reference to FIG. 2. In this device of the present invention, as the frequency increases beyond the value N, the wavelength of the deflected jet becomes such that the position of the wave at the splitter S becomes 180° out of phase with the control pulse, as discussed with reference to FIG. 1. At that point the acoustic pressure signal is 360° out of phase with the control pulse, and combines therewith to increase the deflection of the jet, thereby increasing the gain of the amplifier. The acoustic signal generated by the device compensates for the loss in pressure at the control ports.

As the frequency of oscillation increases still further, the acoustic pulse generated at the splitter moves further out of phase with the pulse at the control port, and therefore will not combine therewith to effectively increase the deflection of the jet. However, the increasing frequency will shorten the wavelength of the deflected jet to the extent that the jet position at vane 2 will then be 180° out of phase with the pulse at the control port. The acoustic signal generated at vane 2, as shown by arrow H in FIG. 1, will then be 360° out of phase with the signal at the control port, and will combine therewith to again increase the deflection of the jet. The result will be a second increase in the gain of the amplifier, as shown by point 2 in FIG. 3. The same will again occur as the frequency is increased to bring the deflected jet 180° out of phase with the control signal at vane 1.

As can be seen in FIG. 3, the successive peaks in the gain of the amplifier at higher frequencies extend the operational bandwidth of the device to a frequency represented by point B. While FIG. 1 illustrates a device having two sets of vanes 1 and 2, it is to be noted that any number of vanes may be used. The position of the vane, that is the distance of the vane from the nozzle 4, will determine the frequency at which the acoustic energy will be effective to assist the control pulse in deflecting the jet. Therefore, an amplifier may be readily designed which will generate peaks in the gain thereof at preselected frequencies.

Figure 4:
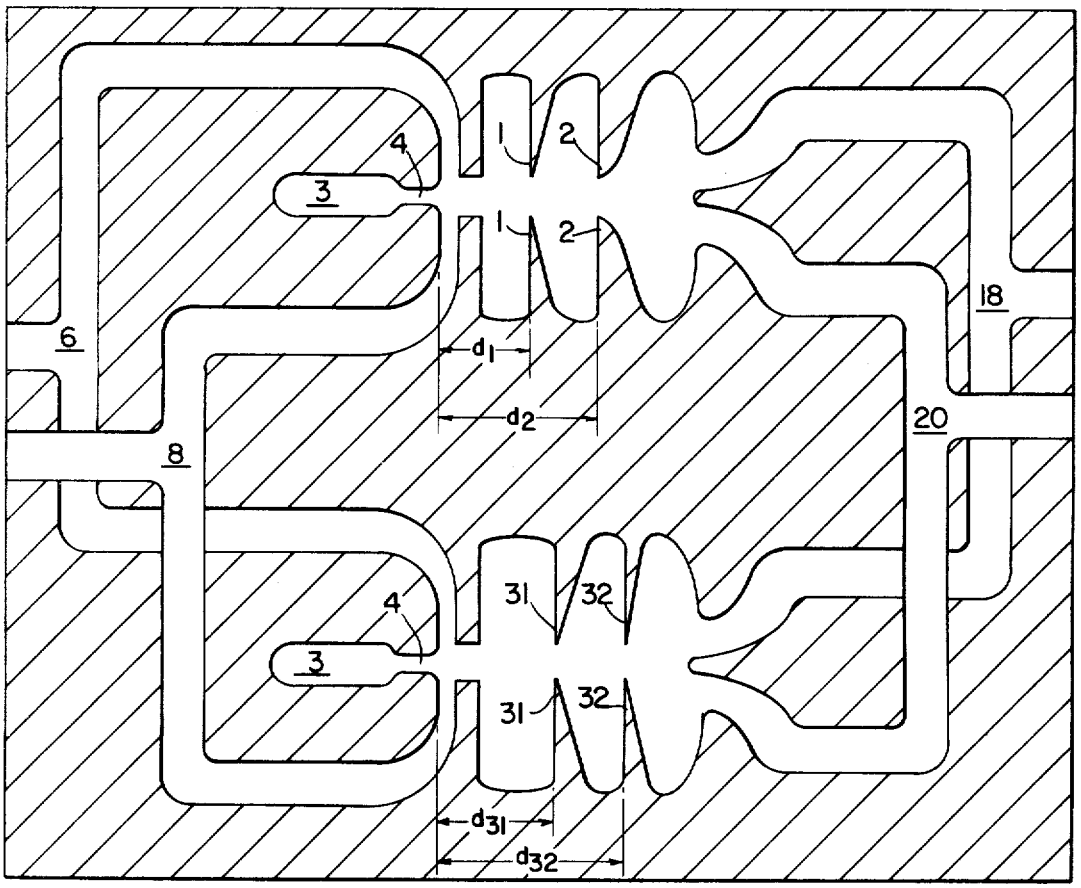
FIG. 4 illustrates an embodiment of the invention comprising two modified amplifiers operating in parallel.

FIG. 4 illustrates an embodiment of the invention which comprises two amplifiers of the invention operating in parallel. It is to be understood that three or more amplifiers may also be operated in parallel as shown in the drawing. The embodiment of FIG. 4 comprises common inputs 6 and 8 for the control pulses of the respective amplifiers, and common outputs 18 and 20. The upper-most amplifier comprises vanes 1 and 2 positioned at distances $d_1$ and $d_2$ from the nozzle 4, respectively. The lower-most amplifier comprises nozzles 31 and 32 set at distances $d_{31}$ and $d_{32}$ from nozzle 4, respectively. It is noted that the distances $d_1$, $d_2$, $d_{31}$, $d_{32}$ are all different from one another. Assuming that the velocities of the respective jets in the amplifiers are equal the peaks in gain generated by vanes 1 and 2 will be generated at frequencies different from the peaks in gain generated by vanes 31 and 32.

Figure 5:
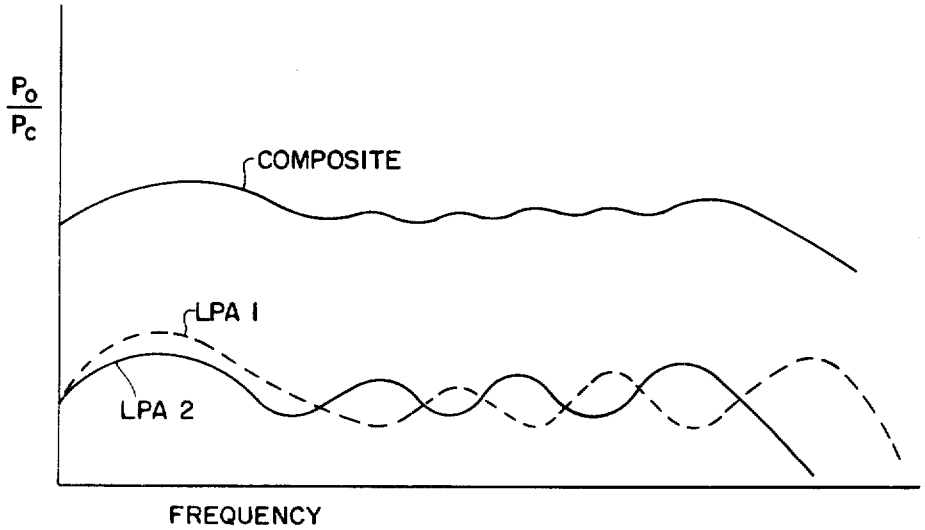
FIG. 5 graphically illustrates the gains of the respective amplifiers of FIG. 4 as they relate to frequency, and the effective gain of the composite system shown in FIG. 4.

FIG. 5 graphically illustrates the gain of the composite amplifier of FIG. 4. The lower curves marked LPA 1 and LPA 2 signify the gain curves of the respective individual amplifiers of FIG. 4. It is noted that each of these lower curves corresponds in shape generally to that of FIG. 3. The composite curve of FIG. 5 illustrates the effective gain of the composite device shown in FIG. 4. Note that since the peaks in gain of the respective lower curves are shifted relative one another the summation of the two results in a curve which is much smoother, having less sharply defined peaks and valleys. The result is an amplifier which has a much more even operation across a wide continuum of frequencies.

As noted above the frequency at which an amplifier of the invention will generate a peak in amplifier gain is determined by the position of the protrusions or vanes in the device. This frequency may also be affected by varying the velocity of the jet from nozzle 4. The velocity of the jet determines the transport time of the fluid to a position adjacent one of the protrusions or vanes, thereby affecting the time at which the jet will be in or out of phase with the pulse at the control port.

While the invention has been disclosed with reference to the specification and attached drawings, I do not wish to be limited to the specific details disclosed therein as obvious modifications can be made by one of ordinary skill in the art.

I claim:

1. A broad band proportional flueric amplifier comprising:

input means for directing a jet of fluid outwardly from a nozzle;

output means comprising two output channels;

control means for deflecting the jet toward an output channel and for causing the jet to oscillate between the output channels; and at least one set of protrusions situated on opposite sides of the jet path, each protrusion being positioned at a distance from the edge of the undeflected jet which does not exceed one half the width of said jet such that the deflected jet will just touch the protrusion when the output of the amplifier is fully saturated.

2. An amplifier as in claim 1, wherein a splitter is positioned between said output channels to separate said channels, and interaction of said jet with said splitter generates acoustic feedback.

3. An amplifier as in claim 1, wherein the frequency at which the jet deflection will be increased is determined by the distance between the nozzle and said protrusion.

4. An amplifier as in claim 1 comprising more than one set of protrusions positioned at selected distances from said nozzle, whereby the deflection of said jet will be increased at several frequencies of oscillation thereof.

5. A system comprising at least two amplifiers as in claim 1, wherein the amplifiers have common output channels and a common control means, wherein the distances of the protrusions from the nozzle in one of said amplifiers differs from said distances in other of said amplifiers, whereby the respective amplifiers will increase the deflection of their respective jets at differing frequencies of oscillation.

6. An amplifier as in claim 1 or 3, wherein the frequency at which the jet deflection will be increased is determined by the velocity of said jet.

7. The invention as in claim 6 wherein said amplifier is a laminar proportional fluid amplifier.

8. The invention as in claim 7 wherein said amplifier has an aspect ratio greater than two.

9. The invention as in claim 8 wherein said control means comprises a plurality of vents maintained at a constant pressure.

10. In a proportional flueric amplifier comprising input means for directing a jet of fluid in a direction outwardly from a nozzle at a predetermined velocity.

output means, displaced in said direction from said nozzle, including two output channels separated by a splitter, and control means for deflecting the jet toward one or the other of the two output channels in accordance with an alternating fluid pressure control signal to cause the jet to oscillate between the two output channels, said control means being connected to receive said control signal through a fluid communication means which significantly attenuates said control signal at higher frequencies and thus determines an upper limit frequency of the amplifier bandwidth, the improvement wherein:

the splitter is displaced in said direction from said nozzle by a distance such that a first alternating acoustic pressure signal generated at the splitter by the oscillating jet combines with the control signal to increase the deflection of the jet at higher frequencies and thus broaden the amplifier bandwidth to an upper limit frequency higher than the upper limit frequency determined solely by the control signal; and the amplifier further comprises at least one set of protrusions disposed on opposite sides of the jet, each protrusion having an edge disposed closely adjacent the path of the oscillating jet to cause the jet to generate an acoustic pressure pulse when the jet is deflected to pass close to the protrusion edge, the acoustic pressure pulses generated by the oscillating jet at the edges of each set of protrusions constituting an additional alternating acoustic pressure signal, the at least one set of protrusions being disposed intermediate the nozzle and the splitter such that the at least one additional alternating acoustic pressure signal combines with the first acoustic signal and the control signal to increase the deflection of the jet at still higher frequencies and thus further broaden the amplifier bandwidth to an upper limit frequency higher than the upper limit frequency determined solely by the control signal and the first acoustic signal.

11. An amplifier as described in claim 10, wherein the control means comprises:

two control ports which are disposed on opposite sides of the jet and are connected through the fluid communication means to receive the alternating fluid pressure control signal; and pressure equalizing means for equalizing pressure on opposite sides of the jet intermediate the control ports and the output means.

12. An amplifier as described in claim 10, wherein the at least one set of protrusions comprises a plurality of sets of protrusions, the distances between nozzle and respective sets of protrusions being determined such the additional alternating acoustic pressure signals generated respectively at the sets of protrusions by the oscillating jet produce respective maximum increases in jet deflection at differing control signal frequencies so as to successively broaden the amplifier bandwidth.

13. A system comprising a plurality of amplifiers as described in claim 10, wherein:

the amplifiers are connected for parallel operation, with all of the amplifier control means being connected to receive the same alternating fluid pressure control signal and the two output channels of all amplifiers being respectively connected to two common output channels of the system; and in each amplifier, the jet velocity and the distances between the nozzle and the splitter and between the nozzle and each set of protrusions are determined such that the alternating acoustic pressure signals generated at the splitters and sets of protrusions of the plurality of amplifiers produce respective maximum increases in jet deflection at differing control signal frequencies.

* * * * *